US009655410B2

(12) United States Patent
Neri

(10) Patent No.: US 9,655,410 B2
(45) Date of Patent: May 23, 2017

(54) COMBINATION HIDDEN NECKTIE RESTRAINT AND BUTTONING-ASSIST DEVICE

(71) Applicant: Frank G. Neri, Vernon, CT (US)

(72) Inventor: Frank G. Neri, Vernon, CT (US)

( * ) Notice: Subject to any disclaimer, the term of this patent is extended or adjusted under 35 U.S.C. 154(b) by 0 days.

(21) Appl. No.: 14/544,098

(22) Filed: Nov. 24, 2014

(65) Prior Publication Data

US 2016/0143399 A1 May 26, 2016

(51) Int. Cl.
*A44B 6/00* (2006.01)
*A47G 25/92* (2006.01)

(52) U.S. Cl.
CPC ..... *A44B 6/00* (2013.01); *A47G 25/92* (2013.01)

(58) Field of Classification Search
CPC ..... A44B 6/00; A47G 25/92; Y10T 24/17; Y10T 24/1924; Y10T 24/19; A41D 25/003
See application file for complete search history.

(56) References Cited

U.S. PATENT DOCUMENTS 208,435 A * 9/1878 Stevens ..... A47G 25/92 24/40
208,858 A * 10/1878 Smith ..... A47G 25/92 24/40
215,612 A * 5/1879 Howland ..... A47G 25/92 24/40
322,284 A * 7/1885 Havell ..... A47G 25/92 24/40
374,715 A * 12/1887 Sullivan ..... A41F 11/02 24/299
691,853 A * 1/1902 Freck ..... A47G 25/92 24/40
901,248 A * 10/1908 Melnick ..... A47G 25/92 24/40
1,463,400 A * 7/1923 Neumann ..... A47G 25/92 24/40
3,494,003 A * 2/1970 Bower, Jr. ..... A44B 6/00 24/66.6
3,529,327 A * 9/1970 Missakian ..... A44B 6/00 24/56
4,942,646 A * 7/1990 Sebastian ..... A47G 25/92 24/40
5,216,785 A * 6/1993 Graef ..... A41D 25/003 24/66.2
5,337,457 A * 8/1994 Chennault ..... A44B 6/00 2/145

(Continued)

*Primary Examiner* — Robert J Sandy
*Assistant Examiner* — Rowland Do
(74) *Attorney, Agent, or Firm* — Steven M. McHugh

(57) ABSTRACT

A device that serves both for retaining a necktie against free displacement and also for assisting buttoning of a garment comprises first and second loop elements and a flexible link element, attached at its opposite ends to the link elements. Each loop element defines a compound aperture having a larger end section, through which a button may pass, a smaller end section by which an element fastening the button may be engaged and secured by shifting of the loop element relative thereto, and a constricting neck section formed at the intersection of said larger and smaller end sections of said loop elements for maintaining the fastening element the button against unintentional release from the smaller end section of the loop element.

6 Claims, 1 Drawing Sheet

(56) References Cited

U.S. PATENT DOCUMENTS

| | | | | | |
|---|---|---|---|---|---|
| 5,347,688 | A * | 9/1994 | Ross | A47G 25/92 | 24/40 |
| 5,353,438 | A * | 10/1994 | Voiles | A41D 25/003 | 2/145 |
| 6,070,434 | A * | 6/2000 | Traver | A44C 25/008 | 2/129 |
| 6,131,200 | A * | 10/2000 | McNamara | A41D 25/003 | 2/144 |
| 6,954,943 | B1 * | 10/2005 | Boyko | A41D 25/003 | 2/156 |
| 7,346,934 | B1 * | 3/2008 | Scott | A41D 25/003 | 2/145 |
| D702,592 | S * | 4/2014 | Aceto | 24/40 | |
| 2004/0006849 | A1 * | 1/2004 | Bishop | A41D 25/003 | 24/3.4 |
| 2007/0119018 | A1 * | 5/2007 | Snyder | A47G 25/92 | 16/8 |
| 2008/0034465 | A1 * | 2/2008 | Pfanner | A41D 25/003 | 2/145 |
| 2013/0025090 | A1 * | 1/2013 | Baker | A47G 25/92 | 24/40 |

* cited by examiner

FIG. 3
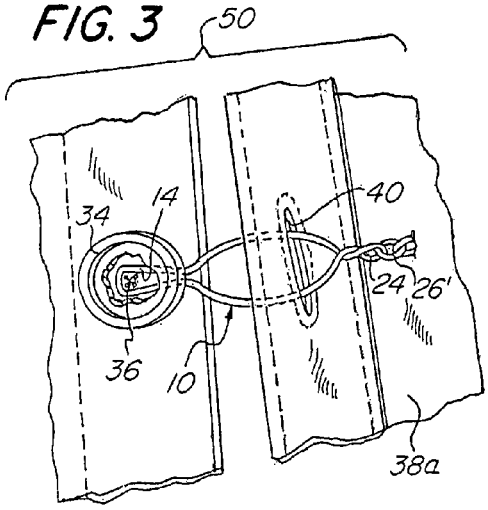
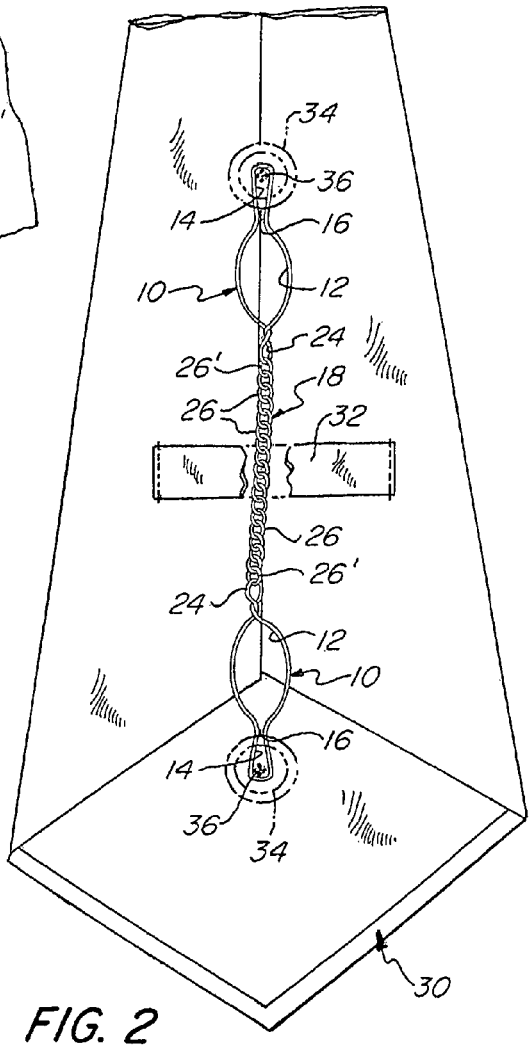
FIG. 2
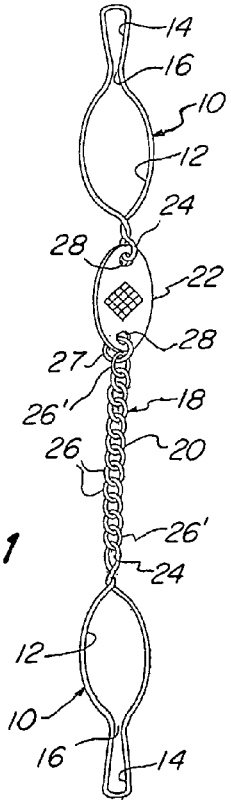
FIG. 1

COMBINATION HIDDEN NECKTIE RESTRAINT AND BUTTONING-ASSIST DEVICE

BACKGROUND OF THE INVENTION

Although visible pins, clips, tie-tacks, and the like, which were traditionally used for securing neckties in place against the wearer's shirt, appear to have now declined in popularity, it is still desirable to provide means for restraining the loose end portions of a necktie against displacement, while being hidden from view. As far as is known, the only such device that has heretofore been available consists of a strip of cloth passed through the crosswise band or loop that is commonly attached on the back of the wider end portion of a necktie, and secured using buttonholes, provided at spaced locations, to receive buttons on the shirt.

While not ostensibly related, a common problem that is encountered by those whose manual dexterity is compromised, through birth defect, illness, or injury, is to independently perform the otherwise facile task of engaging a button in its associated buttonhole. Devices for that assisting function, such as the so-called "Button Helper," are commercially available; and in some instances, such as in a Unikia product, the device may incorporate means for assisting in engaging a zipper, to facilitate its operation as well.

It is broad object of the present invention to provide a device that is capable both of retaining the loose, opposite end portions of a necktie against free displacement, away from a shirt with which the tie is worn, and also of providing assistance, to those whose manual dexterity is compromised, in engaging a button in its associated buttonhole.

Corresponding broad objects of the invention are to provide novel methods for securing a necktie against free displacement of its loose opposite end portions, and also for assisting individuals in carrying out buttoning functions.

More specific objects are to provide such a device, and components thereof, which is and are of incomplex and inexpensive construction, facile to use, may be aesthetically attractive and suited for promotional purposes.

BRIEF SUMMARY OF THE INVENTION

It has now been found that certain of the foregoing and related objects of the invention are readily attained by the provision of a device that serves for both limiting necktie displacement and also for assisting buttoning of a garment. The device comprises first and second loop elements, each constructed to define a compound aperture having a larger end section that is dimensioned and configured for passage therethrough of a common button, secured to a garment by at least one fastening element attached at a central location on the button, a smaller end section that includes a narrow channel extending from the larger end section and being dimensioned and configured to receive such a fastening element while being engaged under the secured button, and a neck or constriction at an intersection of the larger and smaller end sections; and a flexible link element having opposite end portions, one of the first and second loop elements being attached to each of the opposite end portions of the link element at a location adjacent an outer extremity of the larger end section of the aperture of the attached loop element.

The device of the invention can be attached to one or (more commonly) two buttons on a garment, which will normally be buttons that are adjacent to one another, by passing the button or buttons through the larger end section of the aperture in each of the loop elements, and thereafter shifting the loop elements to positions beneath the associated button or buttons so as to cause the button fastener elements to lie within the narrow channels in the loop elements and thereby to cause the loop elements to engage under an associated button. With the link element passed through a strip, loop, or other receiving element on the back of an end portion of a necktie, such an arrangement will cause the device to secure the tie against free movement away from the garment.

Each of the loop elements of the device can also be employed for assisting buttoning of a garment. That is achieved by inserting the loop element through a buttonhole of the garment, manipulating the inserted element to a position above an adjacent button secured to the garment, moving the loop element downwardly so as to cause the button to pass through the larger end section of the compound aperture, and shifting the loop element to a position beneath the button so as to cause the fastening element of the button to lie within the narrow channel of the compound aperture and thereby to engage under the button. Withdrawing the inserted loop element, and thereby the engaged button, back through the buttonhole will effect engagement of the button in the buttonhole.

Normally, the larger end section of the aperture in each of the loop elements of the device will be generally circular (e.g., truly round, substantially or truly elliptical, or oval), and the narrow channel of the smaller end portion of the aperture will desirably taper to form the neck at its intersection with the larger section. The loop elements will preferably be relatively thin and planar, so as to enable them to readily fit between a secured button and the garment, and will be fabricated from a substantially rigid, but resiliently deflectable, material so as to facilitate manipulation and capture of a button (albeit compression of the fastener element, and subsequent expansion to resume its normal volume, may suffice to permit passage through the constriction and maintenance within the smaller end section); the loops will preferably be of formed-wire construction. The flexible link element will normally be a metal chain (although wire, plastic chains, solid fibers and filaments, etc. may be employed as well), and the flexible link element will advantageously incorporate, along its length, at least one small, plate-like piece constructed for bearing indicia, such as by having a logo or other trade designation stamped, engraved, printed, or otherwise applied to it.

Another object of the invention is attained by the provision of a method for securing the loose end portions of a necktie against free movement away from a garment, using the device described herein. The method comprises the steps: passing the link element of the device through a strip or loop at the back of the necktie; attaching the device to at least one, but usually two, buttons on a marginal portion at the front of a garment, by passing one of the button or buttons through the larger end section of the aperture of each of the loop elements; and thereafter shifting the loop elements to positions beneath an associated button so as to cause the button-fastening elements to lie within the narrow channels of the loop elements and thus to engage under the button. It will be appreciated that the device may most conveniently be used by attaching one of the loop elements to a button before the link element is passed through the receiving element on the necktie.

A further object of the invention is attained by the provision of a method for assisting buttoning of a garment, or the like, using the device described herein. The method comprises the steps: inserting one of the loop elements of the device through a buttonhole of the garment; manipulating the inserted loop element so as to cause an adjacent button, secured to the garment, to pass through the larger end section of the compound aperture thereof; shifting the inserted loop element to a position beneath the button so as to engage under the button and cause the fastening element of the button to lie within the narrow channel of the compound aperture of the loop element; and withdrawing the inserted loop element, and thereby the engaged button, back through the buttonhole for engagement of the button therein.

BRIEF DESCRIPTION OF THE SEVERAL VIEWS OF THE DRAWINGS

FIG. 1 is a plan view showing one embodiment of the device of the invention.

FIG. 2 is a fragmentary view illustrating a second embodiment of the device of the invention and showing it in use for restraining a loose end portion of necktie against displacement from a wearer's shirt.

FIG. 3 is a fragmentary view, drawn to an enlarged scale, showing the device of the invention in use for assisting in effecting engagement of a button, secured to a shirt, in an adjacent buttonhole.

DETAILED DESCRIPTION OF THE INVENTION

As seen in FIG. 1, the device of the invention consists of a pair of loop elements, each being generally designated by the numeral 10, being formed of resilient (spring) metal wire, and defining a compound aperture. The aperture consists of a relatively large, generally elliptical end section 12 and a relatively small end section in the form of a narrow channel 14; a constriction or neck 16 is formed at the intersection of the end sections 12 and 14 of the compound aperture.

The two loop elements 10 are connected to one another by a flexible link element, generally designated by the numeral 18. The link element 18 consists of a length of chain 20 comprised of links 26 and, in the embodiment illustrated, a plate-like piece 22 at one end; in some embodiments such a piece 22 will desirably be provided at both ends of the chain 20. Each loop element 10 has an eyelet 24 adjacent an outer extremity of the larger aperture section 12 and engaged by the endmost link 26' at one end of the chain 20; the eyelets may be separately fabricated attached elements, or they may be integrally formed, such as for example by twisting wires comprising the loop elements 10. A endmost link 26' at the opposite end of the chain 20 engages a ring element 27, which is received in an aperture 28 in one end of the plate 22. The eyelet 24 on the second loop element 10 is received in a second aperture 28 formed in the opposite end of the plate 22.

A modified embodiment of the device is employed in the arrangement depicted in FIG. 2, in use for the securement of the loose end portion of a necktie, generally designated by the numeral 30, against free displacement away from the shirt (not shown in this figure) of a wearer. The plate-like piece 22 is omitted from the retaining device of FIG. 2, but it was otherwise essentially identical to the device of FIG. 1, as indicated by the use of common reference numbers for the parts and elements thereof.

In serving its intended purpose, the device is passed through the transverse fabric loop or strip 32 (shown broken away, to expose the underlying section of the link element 18) that is normally affixed, as a receiving element, to the back of the wider end portion of a necktie 30 (the narrower end portion of the tie usually being passed through the loop 32 so as couple it to the wider end portion). The loop 10 at one end of the device is secured under a button 34 sewn on a marginal portion at the front of the shirt (not shown in this figure), with the fastening threads 36 lying within the channel 14 of its aperture, and with the neck portion 16 helping to maintain the established relationship; the loop element 10 at the opposite end of the device is similarly engaged beneath an adjacent button 34. It will readily be appreciated that this simple arrangement will effectively maintain the end portions of the necktie 30 against free displacement away from the wearer's shirt, while being hidden from view in normal use.

FIG. 3 of the drawing shows the device of the invention (as depicted, for example, in either FIG. 1 or FIG. 2) utilized as a tool for assisting buttoning. All common elements present in FIGS. 1 and 2, previously described, bear the same reference numbers in FIG. 3.

To effect buttoning using the device, one of the loop elements 10 is initially inserted through a buttonhole 40 made in the marginal portion **38*a* along one side of the front of the shirt 50. The inserted loop element 10 is then manipulated (the attached chain 20 and incorporated plate 22, if present, may serve to facilitate gripping for manipulation) so as to align the larger end section 12 of its aperture over the button 34 for passage therethrough. The loop element 10 is then shifted so as to cause the button-fastening threads 36 to enter, and lie within, the narrow channel 14, ultimately to bear upon the material of the element 10 loop at the outer extremity of the smaller end portion of its aperture; that is the relationship depicted in FIG. 3, with the button 34 being broken away to better show it. Thus, upon withdrawal of the loop element 10, back through the buttonhole 40, the button 34 will follow and also be drawn through the buttonhole, in an optimal orientation, so as to fasten the button 34. Obviously, the loop element 10 may then be readily disengaged and removed from the button 34**.

While the plate-like piece 22 (shown in FIG. 1) is incorporated into the flexible link element 18 primarily to serve decorative and/or commercial functions (such as for the receipt of a logo or other trade designation, as suggested by the square of surface cross-hatching), the link element will be entirely functional, for its intended purposes, in its absence. If positioned adjacent to a loop element 10, however, such a piece 22 may afford a better finger grip and thereby improve the ability of a user to manipulate the loop element for locating it relative to, and securing it upon, a button. As mentioned above, two or more plate-like pieces may be incorporated into a link element (indeed, the link element might be comprised essentially of a chain of plate-like pieces), and a plate-like piece may desirably be positioned adjacent each loop element, such as to facilitate its manipulation.

Typically, the device of the invention will have an overall length of about 4½ to 5 inches; each loop may be about 1 to 1½ inches long, with the larger aperture portion being about ⅜ inch wide and ¾ inch long and the smaller aperture portion being about ½ inch long and ⅛ inch wide at its widest point (tapering to about 1/64 inch in width, or indeed to establish direct contact, or zero clearance, between the opposing elements, at the neck portion); an incorporated plate-like piece would typically be about ⅝ inch in length or diameter.

The loop elements of the device will normally be made of metal (e.g., spring temper phosphorous bronze, stainless steel, etc.), with any separate eyelet piece being joined thereto by welding or soldering, as may be most appropriate. The chain will typically be fabricated from brass or stainless steel (with pieces again being affixed by welding or soldering, as appropriate), and any logo plate incorporated will typically be made of brass or nickel-brass alloy. Parts fabricated from suitable plastics, natural materials, etc., may also be employed, however, as will be apparent to those of ordinary skill in the art based upon the description provided herein.

Thus, it can be seen that the present invention provides a device that is capable both of retaining the loose, opposite end portions of a necktie against free displacement away from a shirt with which it is worn, and also of providing assistance, to those whose manual dexterity is comprised, in engaging a button in its associated buttonhole. The invention further provides novel methods for securing a necktie against free displacement of loose opposite end portions, and also for assisting individuals in carrying out buttoning functions. The device is of incomplex and inexpensive construction, is facile to use, and may be aesthetically attractive and/or well suited to serve promotional purposes.

Having thus described the invention, what is claimed is:

1. A device that serves both for limiting necktie displacement and for also assisting buttoning of a garment, comprising:

first and second loop elements, each loop element being constructed to define a compound aperture having a larger end section that is dimensioned and configured for passage therethrough of a common button that is secured to a garment by at least one fastening element attached at a central location on the button, a smaller end section that includes a narrow channel extending from said larger end section and being dimensioned and configured for receiving such a fastening element while engaged under the secured button, and a neck section at an intersection of said larger end and smaller end sections of said aperture in each of said loop elements, wherein said neck section is narrower than said smaller end section; and a flexible link element having opposite end portions, wherein said first loop element is attached to one end portion of the flexible link element and said second loop element is attached to the other end portion of the flexible link element said first and second loop elements being attached to the flexible link element at a location adjacent an outer extremity of the larger end section of said aperture of said attached loop element;

whereby said device can be attached to at least one button on a garment by passing the at least one button through the larger end section of said aperture of each of said loop elements and thereafter shifting said loop elements to positions beneath the at least one button so as to cause the fastening elements of the button to lie within said narrow channels and thereby cause said loop elements to engage under the at least one button such that, with said link element passed through a receiving element on the back of an end portion of a necktie, the device will serve to secure the end portion of the necktie against free movement away from the garment; and whereby each of said loop elements can be employed for assisting buttoning of a garment by inserting one of said loop elements through a buttonhole of the garment, manipulating said inserted loop element so as to cause an adjacent button secured to the garment to pass through said larger end section of said compound aperture thereof, shifting said inserted loop element to a position beneath the button so as to engage under the button and cause the fastening element of the button to lie within said narrow channel of said compound aperture, and withdrawing said inserted loop element, and thereby the engaged button, back through the buttonhole to effect engagement of the button therein;

said neck section at the intersection of said end sections of said each loop element providing a constriction for maintaining said fastening elements against unintended exit from said narrow channel thereof.

2. The device of claim 1 wherein said larger end section of said aperture in each of said loop elements is generally circular.

3. The device of claim 1 wherein said loop elements are relatively thin and planar, so as to enable them to readily fit between a secured button and the garment, and are fabricated from a substantially rigid material.

4. The device of claim 3 wherein said material of fabrication of said loop elements is a resiliently deflectable metal.

5. The device of claim 4 where said loop elements are of formed wire construction.

6. The device of claim 1 wherein said flexible link element comprises a chain.

* * * * *